United States Patent [19]

Cagneux et al.

[11] Patent Number: 5,033,765

[45] Date of Patent: Jul. 23, 1991

[54] SKI HAVING IMPROVED SHOCK ABSORPTION AND VIBRATION RESISTANCE

[75] Inventors: Yves Cagneux, Annecy Le Vieux; Denis Gasquet; Maurice Legrand, both of Annecy, all of France

[73] Assignee: Salomon S.A., Annecy Cedex, France

[21] Appl. No.: 194,129

[22] Filed: May 16, 1988

[30] Foreign Application Priority Data

May 22, 1987 [FR] France ..... 87-07543

[51] Int. Cl.[5] ..... A63C 5/07

[52] U.S. Cl. ..... 280/602; 280/610

[58] Field of Search ..... 280/600, 601, 602, 605, 280/609, 610; 441/65, 68, 79; 114/274, 283, 288

[56] References Cited

U.S. PATENT DOCUMENTS

| | | | |
|---|---|---|---|
| 2,695,178 | 11/1954 | Rheinfrank | 280/610 |
| 3,762,734 | 10/1973 | Vogel | 280/610 |
| 4,405,149 | 9/1983 | Piegay | 280/602 |
| 4,412,687 | 11/1983 | Andre | 280/610 |
| 4,627,635 | 12/1986 | Koleda | 280/610 |
| 4,639,009 | 1/1987 | Meatto et al. | 280/602 |

FOREIGN PATENT DOCUMENTS

| | | |
|---|---|---|
| 0193519 | 9/1986 | European Pat. Off. . |
| 0985174 | 7/1951 | France . |
| 1124600 | 4/1955 | France . |
| 1304880 | 11/1961 | France . |
| 2099849 | 3/1972 | France . |
| 2437225 | 4/1980 | France . |

*Primary Examiner*—Andres Kashnikow
*Assistant Examiner*—Richard Camby
*Attorney, Agent, or Firm*—Sandler, Greenblum & Bernstein

[57] ABSTRACT

A ski comprises an elongated body having opposed lateral surfaces and opposed upper and lower walls, a longitudinal core having upper and lower walls extending along the length of the body between front and rear ends of the ski, mechanical resistance elements, internal longitudinal shock absorption elements made of a viscoelastic material, and filling elements connecting the resistance elements to the other elements. At least one of the internal shock absorption elements is a strip of viscoelastic material which is substantially continuous over the entire length of the body of the ski. The width of the strip is limited by the lateral surfaces of the ski, and the thickness of the strip is limited by a wall of the core and a wall of the body. The strip has a thickness along the length of the body which is a nonconstant function of the length of the body conferring on the ski mechanical shock absorption properties which vary along the length of the ski.

58 Claims, 2 Drawing Sheets

SKI HAVING IMPROVED SHOCK ABSORPTION AND VIBRATION RESISTANCE

BACKGROUND OF THE INVENTION

1. Field of the Invention

This invention relates to skis utilized in Winter sports, and adapted to slide on snow and ice.

2. Related Applications

The following copending applications disclose subject matter related to subject matter in the present application:

Ser. No. 156,962 filed Feb. 18, 1988;
Ser. No. 157,467 filed Feb. 18, 1988;
Ser. No. 194,147 filed May 16, 1988 (P6373);
Ser. No. 194,320 filed May 16, 1988 (P6375).

3. Description of Background Information

A ski generally comprises a lower sliding surface having an angle iron on each lateral edge for gripping snow, two lateral surfaces defining the width of the ski, and an upper surface having binding means located in a central binding zone by which a user attaches his boot to the ski. The front or leading end of the ski is curved upwardly to form a spatula; and the ski is relatively narrow in width compared to its length which defines a longitudinal direction. The lower surface of the ski defines a contact zone located between a front contact line and a rear contact line.

In conventional skis, the thickness of the body of the ski varies along the length of the ski in the longitudinal direction having a maximum in the central binding zone where the flexional movements are a maximum during the use of the ski. In this zone, internal flexion couples are greatest during the use of the ski. Because the thickness of the ski in the central binding zone is a maximum, and the thickness near the front and rear ends is a minimum, a uniform load distribution is achieved as disclosed in French Patent No. 985,174, for example.

Conventional skis have a composite structure in which different materials are combined in a manner such that each composite operates in optimal fashion taking into account the distribution of the mechanical stresses. The composite structure comprises resistance or reinforcing strips of a material having a high mechanical resistance to strain and substantial rigidity so as to resist flexional and torsional stresses produced in a ski during its use. The conventional structure usually includes filler material, and sometimes shock absorption strips.

The two principal composite structures finding current wide scale application in skis are the so-called sandwich and casing structures. In a typical casing structure, such as described in French Patent No. 985,174, and FIG. 3 of French Patent No. 1,124,600, the ski comprises an internal core made of cellular material which may be partially hollow, and mechanical resistance strips surrounding the core in the form of layers that constitute a casing for the core.

In a typical sandwich structure, such as described in U.S. Pat. No. 4,405,149, the ski comprises a central core formed from cellular material which can be partially hollow, and reinforcements on its upper and lower surfaces formed by resistance layers having requisite resistance and rigidity properties greater than those of the core itself. Typically, discontinuous strips of prestressed viscoelastic material are bonded to the core along two or three separate longitudinally spaced zones. At least one of these zones is near the spatula of the ski, and another of the zones is located adjacent the binding zone. Swiss Patent No. 525,012 discloses longitudinal strips formed of viscoelastic material bonded to the upper surface of the ski to form a sandwich structure.

In all of the known skis using a sandwich construction in which the shock absorption strips are formed of viscoelastic material, both the core and the strips have a uniform width along their entire length. When the strips are positioned substantially over the entire length of a ski, it has been found that skiing comfort is improved, but that the gripping and holding power of the ski during turning maneuvers are reduced. In efforts to solve this problem, it has been proposed to limit the length of the shock absorber to the front half of a ski, i.e., to the zone between the spatula and the binding zone. Such an expedient, however, appears to provide no advantage over a construction in which the shock absorber extends over the entire length of the ski. Finally, in the case where the strip is segmented or divided into a plurality of separate segments, as is described in U.S. Pat. No. 4,405,159, the shock absorption effect is reduced, and the influence of the segments becomes practically negligible at the frequencies of vibration produced in the ski under normal use when a boot is attached to the ski by a binding.

Furthermore, in conventional skis using a sandwich construction, the shock absorption element constitutes a supplemental element which complicates the manufacture of the ski and substantially increases its cost.

An object of the present invention, therefore, is to overcome the disadvantages of known ski structures and provide a ski which is relatively simple to manufacture and whose shock absorption properties are such as to produce a remarkable increase in both comfort and technical performance.

Another object of the invention is to confer to the body of the ski, a shock absorption property which is a non-constant function of the length of the ski. A further object of the present invention is to obtain a desired non-constant distribution in the shock absorption properties of a ski without major modification of its structure in order to achieve homogeneity of structure and behavior, and good distribution of reactions along the length of the ski thus providing the user with an impression of comfort and regularity in the reactions of the ski to its travel on snow.

SUMMARY OF THE INVENTION

A ski for use on snow comprises a body whose width is established by opposed lateral surfaces, and whose thickness is established by opposed upper and lower walls, a longitudinal core extending along the length of the body between front and rear ends of the ski and whose thickness is established by upper and lower walls, mechanical resistance elements, internal longitudinal shock absorption elements made of a viscoelastic material, and filling elements connecting the resistance elements to the other elements. According to the present invention, at least one of said internal shock absorption elements is a strip of viscoelastic material which is substantially continuous over the entire length of the body of the ski. The width of said strip is limited by the lateral surfaces of the ski and the thickness of said strip is limited by a wall of the core and a wall of the body; and the thickness of said strip along the length of the body is a nonconstant function of the length of the body conferring to the ski mechanical shock absorption properties which vary along the length of the ski.

In one form of the invention, the shock absorption elements comprise an upper strip positioned between the upper wall of said core and the upper wall of the body. In another form of the invention, the shock absorption elements comprise a lower strip positioned between the lower wall of said core and the lower wall of the ski. Preferably, however, the shock absorption elements comprise an upper strip positioned between the upper wall of said core and the upper wall of the body and a lower strip positioned between the lower wall of said core and the lower wall of the body. In addition, the shock absorption elements may also comprise tWo lateral strips of viscoelastic material that link said upper and lower strips.

As a consequence of this construction, a predetermined distribution of shock absorption properties can be built into a ski. Vibrations that are most disturbing during the time a ski is in use are reduced by the structure according to the present invention so as to be almost imperceptible. Simultaneously, the absence of vibrations in the same range of frequencies produces a substantial increase in the gripping power of the ski on ice or hard snow, in its stability on bumpy snow, and in its stability in turns, and during its sliding.

The present invention thus provides a ski whose body comprises a longitudinal core, mechanical resistance strips, internal shock absorption means of viscoelastic material, and filling material connecting the resistance strips to the other components. The internal shock absorption means are in the form of at least one substantially continuous strip of viscoelastic material positioned between the core and either the upper or lower walls of the shell defining the body of the ski. The thickness of such strip is established by the spacing between corresponding upper and lower exteriors walls of the ski and respective upper and lower walls of the core; and the width of the strip is established by the spacing between the lateral walls of the shell of the ski. The wall of the core in contact with the strip is provide with a depression filled with viscoelastic material. The resultant variation in thickness of the strip as a function of its length confers to the body of the ski shock absorption properties that are a nonconstant function of the length of the ski. Where the thickness of the strip is increased, i.e., in the vicinity of the depression in the core, the shock absorption effect is locally increased. Moreover, the shock absorption is effective over a greater range of vibration frequencies.

The internal shock absorption means may also be in the form of a pair of continuous strips of viscoelastic material, one interposed between the top wall of the body and the top wall of the core, and one interposed between the bottom wall of the body and the bottom wall of the core. The natural cross-sectional shape of a ski, as a function of length along the ski, produces a natural variation in cross-section of the strip, particularly if the thickness of the core is uniform. Such variation is enhanced by providing suitable variations in the thickness of the core along its length.

In the case of either one or two strips, suitable variations in thickness of the core induce corresponding variations in thickness of the strips. Zones in which the thickness of the core is reduced correspond to the zones in which the thickness of the strips of viscoelastic material is increased.

According to the present invention, the shock absorption is preferably increased in certain particular zones along the length of the ski by providing in such zones by locally reducing the thickness of the core. A reduction in thickness may be achieved, for example, by providing a depression in either or both of the upper or lower walls of the core which contact the viscoelastic material.

According to one embodiment the core comprises on its upper wall at least one depression filled with viscoelastic material. Alternatively, or in addition, the core may have on its lower wall another depression that is filled with viscoelastic material.

The variable shock absorption structure according to the present invention can be applied to skis having a sandwich resistance structure. Likewise, the present invention can be applied to skis having a casing resistance structure. In either case, the result is to substantially increase the gripping qualities of the ski by a combination of the intrinsic casing qualities, and the antivibrational effect of the structure according to the invention.

The shock absorption elements may be positioned symmetrically with respect to a longitudinal median plane of the ski. However, improved results are obtained when the shock absorption elements are asymmetrically positioned with respect to the longitudinal vertical median plane of the ski. In addition, the asymmetry may be a function of the longitudinal position being considered along the length of a ski. Preferably, the cross-section of the shock absorption elements varies in a continuous manner along the length of the body of the ski, producing a continuous variation of the mechanical shock absorption.

BRIEF DESCRIPTION OF THE DRAWINGS

Embodiments of the present invention are shown in the accompanying drawings wherein.

DESCRIPTION OF PREFERRED EMBODIMENTS

Figure 1:
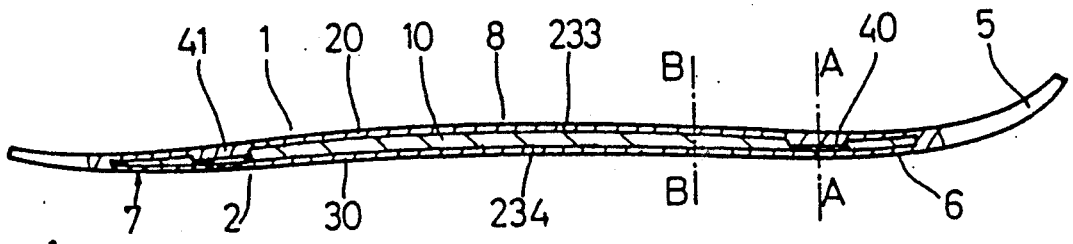
FIGS. 1-5 are longitudinal cross-sectional views of five embodiments of a ski according to the present invention, the views being taken through a median longitudinal vertical plane I—I of the ski.
Figure 8:
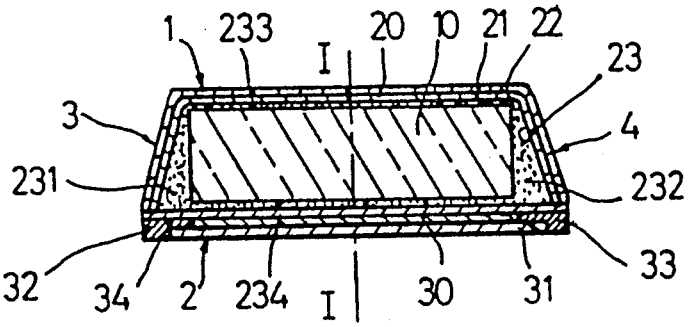

Referring first to FIG. 8 of the drawings, a ski according to the present invention includes upper surface 1, lower surface 2 (also referred to as a sole or sliding surface), first lateral exterior appearance surface 3, second lateral exterior surface 4, and a front end which is upwardly curved in the form of spatula 5 (FIG. 1). Lower surface 2 of the ski between front contact line 6 and rear contact line 7 defines a snow contact zone of the ski which, when not in use, may be arched upwardly or cambered. The body of the ski, or the portion of the ski included between front contact line 6 and rear contact line 7, has a maximum thickness in central zone 8, and a thickness which decreases progressively approaching both the front contact line 6 and rear contact line 7.

Figure 7:
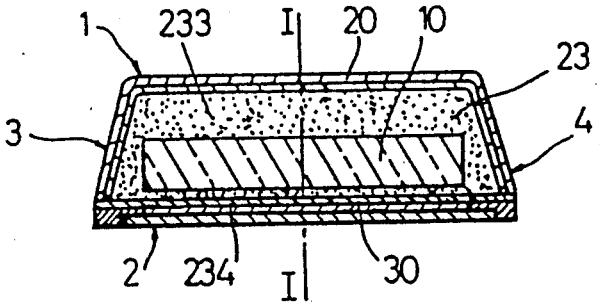
FIGS. 7 and 8 are transverse cross-sectional views of the ski of FIG. 1 along vertical planes A—A and B—B respectively.

The ski may have, as shown in FIGS. 7–8, a symmetrical mechanical resistance casing structure with respect to vertical longitudinal median axis I—I of the ski which defines a longitudinal median plane. As shown in FIG. 8, the ski is constituted by four principle portions: core 10 having a substantially rectangular cross-section, shell 20, lower element 30, and filling 23.

Core 10 may be a cellular structure such as wood, synthetic foam, or aluminum honey-comb. The core may be partially hollow and may be constituted, for example, by metallic or plastic tubes.

Shell 20, in this embodiment, is a composite shell comprising outer exterior layer 21 of thermoplastic material, for example, and reinforcement layer 22 constituted from a material having high mechanical resistance such as stratified or alloyed aluminum, for example.

Exterior layer 21 may be a thermoplastic material such as ABS (acrylonitrile butadiene styrene), a polyamide, or a polycarbonate.

Reinforcement layer 22 may be one or more sheets or layers of woven glass, carbon or other material, these layers preferably being pre-impregnated with a thermoplastic resin such as a polyetherimide, or with a thermosetting resin such an epoxyde, or a polyurethane. The fabric is preferably oriented, and may have 90% of its fibers arranged in the longitudinal direction of the ski, and 10% in the transverse direction of the ski.

Interior filling layer 23, of viscoelastic material, ensures a linkage or connection between core 10 and reinforcement layer 22. The application to skis of viscoelastic material to provide shock absorption is described in the previously noted patents identified above. As is known, a suitable viscoelastic material can be selected from thermoplastic materials, synthetic resins, silicon elastomers, rubbers, butyl polychloroprenes, acrylic nitriles, ethylenes, propylenes, and ionomers. Such viscoelastic materials have properties that lie between those of a solid and a liquid, and serve to at least partially absorb shock and deformation forces. In liquids, stress is directly proportional to the rate of deformation; and in solids, stress is directly proportional to deformation. In a viscoelastic material, however, stress is a function of both the rate of deformation and of the deformation itself. In all of the embodiments, viscoelastic filling layer 23 is securely attached to the mechanical resistance elements by bonding or any other known process.

Lower element 30 comprises sole 31 of polyethylene constituting lower or sliding surface 2 of the ski. Lateral corner angles 33 at the lateral edges of sole 3 are of steel; and lower resistance layer 34 is a mechanically resistant material. For example, lower resistance layer 34 may have a composite structure comprising glass fibers and aluminum alloy or stratified aluminum. Lower resistance layer 34 is integrated along its lateral edges with with the corresponding lower lateral edges of reinforcement layer 22 of shell 20.

Reinforcement layer 22 of shell 20 has, as shown in the drawings, a cross-section in the form of an inverted U-shaped structure which constitutes an upper resistance layer connected to two lateral resistance layers attached at their lower edges to the lateral edges of lower resistance blade 34. As a result, reinforcement layer 22 of the shell and of the lower resistance layer 34 comprise an enclosed casing structure that surrounds core 10.

In each of the embodiments shown, the thickness of core 10 is a nonconstant function of the length of the core; and the width of the core is constant. Filling layer 23 is a viscoelastic material in the form of first lateral strip or layer 231, second lateral strip or layer 232, upper strip 233, and lower strip 234. All of the strips are integrally interconnected with the result that filling layer 23 is integral. Variations in thickness of core 10 as a function of the length of the core causes variations in the shape of the cross-section of upper strip 233 and/or lower strip 234. For example, the cross-section of viscoelastic material is greater in FIG. 9, i.e., in the plane of cross-section C—C, then in the plane of cross-section A—A shown in FIG. 8.

The width of upper strip 233 is established by the spacing between lateral surfaces 3, 4 of the ski; and the thickness of the strip is established by the spacing between the upper wall of the ski formed by shell 20 and the upper wall of core 10 which faces the upper wall of the ski. Likewise, the width of lower strip 234 is established by the spacing between lateral surfaces 3, 4 of the ski; and the thickness of this strip is established by the spacing between the lower wall defined by element 30 of the ski and the lower wall of core 10 which faces the lower wall of the ski.

Figure 6:
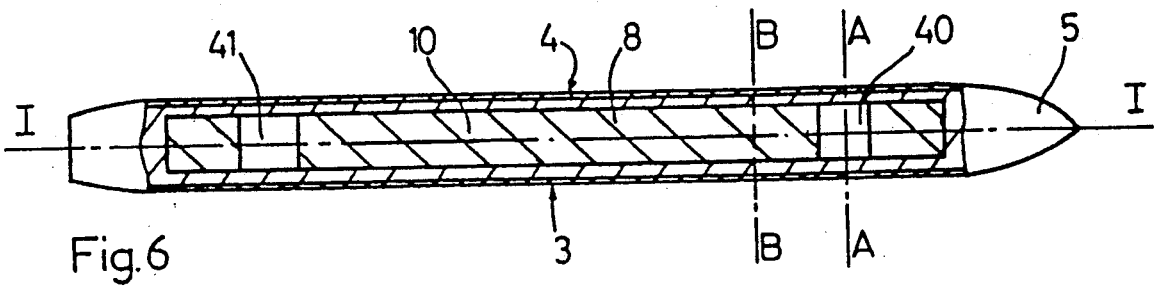
FIG. 6 is a top view in partial cut-away of the ski shown in FIG. 1.

According to the invention, core 10 comprises zones of reduced thickness created by providing depressions in one or the other or both of the upper or lower walls of the core. In the embodiment of the ski shown in FIGS. 1 and 6, core 10 is provided with depressions 40, 41 in the upper wall of the core. Each depression 40, 41 is entirely filled by the viscoelastic material forming upper strip 233. As a result, in the zone of depression 40 where the thickness of the core is reduced, the thickness of the viscoelastic volume 233 is correspondingly increased.

The particular shape of core 10 makes it possible, in a simple way, to define local regions or zones in the upper or lower strips in which the cross-section of viscoelastic material is increased to ensure an improved shock absorption. For example, as shown in FIGS. 7 and 8, depression 40 reduces the thickness of the core to substantially half the thickness on either side of the depression. This percentage variation in thickness is by way of example only.

In the embodiments shown in FIGS. 1, 6, 7, and 8, core 10 has depression 40 located in the upper wall of the core adjacent the front end of the ski. Depression 41 in the core is located in the upper wall thereof adjacent the rear end of the ski.

Figure 2:
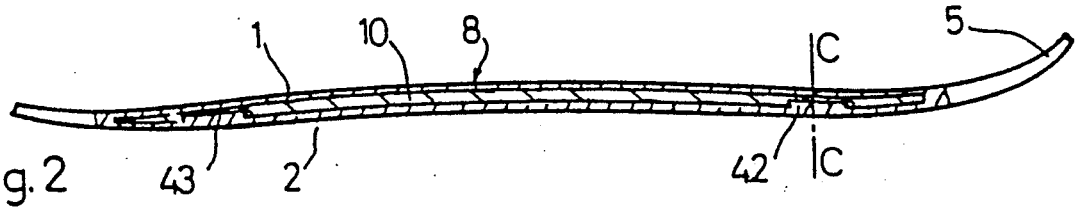

In the embodiment of FIG. 2, core 10 has depression 42 located in the lower wall of the core adjacent the front end of the ski; and depression 43 is located in the lower wall adjacent the rear end of the ski.

Figure 3:
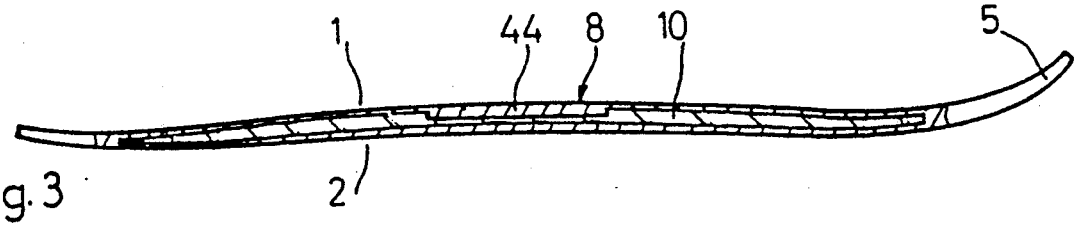

In the embodiment of FIG. 3, core 10 has a single depression 44 located in the upper wall of the core in the central portion 8 of the ski.

Figure 4:
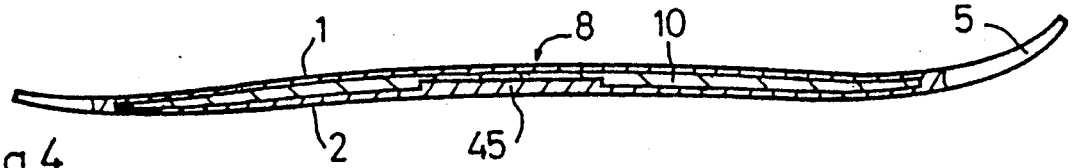

In the embodiment of FIG. 4, core 10 has a single depression 45 located in the lower wall of the core in central portion 8 of the ski.

Figure 5:
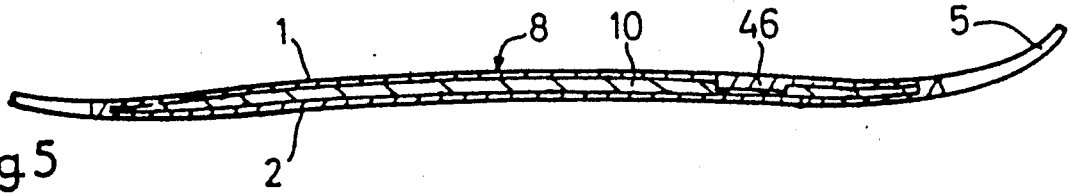

In the embodiment of FIG. 5, core 10 has a single depression 46 located in the upper wall of core 10 in the front third of the body of the ski about midway between front contact line 6 and the binding zone 8. This location is by way of example only.

Figure 9:
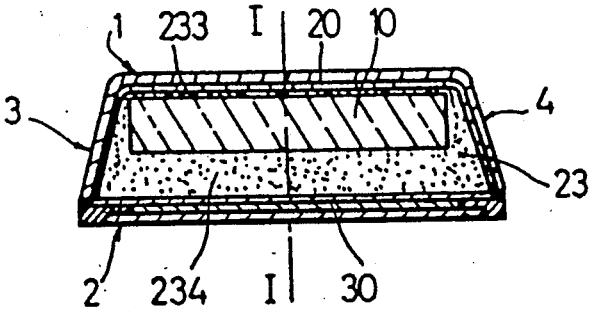
FIG. 9 is a transverse cross-sectional view of the ski of FIG. 2 taken along vertical plane C—C.

In the embodiments in which the depressions are provided in the lower wall of the core, the ski has a transverse cross-section such as shown in FIG. 9, corresponding to the transverse cross-sectional plane C—C of FIG. 2. In the depression, core 10 has a thickness that, for example, is reduced by half; and the lower strip 234 has an increased thickness of the same value.

Figure 10:
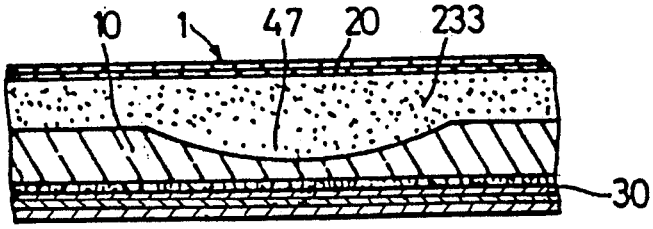
FIG. 10 is a partial longitudinal cross-sectional view a ski according to another embodiment.

The depressions shown in FIGS. 1-9 have a rectangular shape in transverse and longitudinal cross-section. Moreover, each depression extends completely across the width of the core. Other shapes and dimensions of the depressions can be utilized according to the invention, however. For example, the depressions may have rounded walls 47 as shown in FIG. 10, or have oblique, or curved walls; and the depressions may extend over less than the complete width of the core.

As shown in the drawings, core 10 is entirely surrounded with viscoelastic material. However, this is not always necessary. For example, a ski according to the present invention may have only upper strip 233; and the ski may optionally exclude lateral strips 231, 232. Alternatively, a ski according to the present invention may have only lower strip 234.

While the drawings show skis whose structure is symmetrical with respect to the vertical longitudinal median plane I—I of the ski, the effects according to the present invention can likewise be obtained with asymmetrical structures. For example, ski walls 3 and 4 may be asymmetrical. The lateral walls can likewise have an inclination different from that which is shown. The presence of exterior layer 21 is not indispensable for obtaining the particular effects according to the invention, and one as a consequence, the exterior layer and the reinforcement layer 22 could be combined into a single reinforcement layer.

The preceding embodiments have been described with reference to a casing resistance mechanical structure. One can however apply the structure according to the invention, for the manufacture of shock absorption elements, in the case of a mechanical sandwich-type resistance structure.

The ski according to the present invention can be manufactured by traditional means, for example by a process described in French Patent No. 985,174.

However, the ski according to the invention can likewise be manufactured according to a process described in French Patent No. 87 03119.

Although the invention has been described with reference to particular means, materials, and embodiments, the invention is not limited to the particulars disclosed but extends to all equivalents within the scope of the claims.

We claim:

1. A ski for use on snow comprising a body whose width is established by opposed lateral surfaces, and whose thickness is established by opposed upper and lower walls, a longitudinal core extending along the length of the body between front and rear ends of the ski and whose thickness is established by upper and lower walls, mechanical resistance elements, internal longitudinal shock absorption elements made of a viscoelastic material, and filling elements connecting the resistance elements to the other elements, wherein:

(a) at least one of said internal shock absorption elements is a strip of viscoelastic material which is substantially continuous over the entire length of the body of the ski;

(b) the width of said strip is limited by the lateral surfaces of the ski and the thickness of said strip is limited by a wall of the core and a wall of the body; and (c) the thickness of said strip along the length of the body is a nonconstant function of the length of the body conferring to the ski mechanical shock absorption properties which vary along the length of the ski.

2. A ski according to claim 1, wherein the filling elements are viscoelastic material.

3. A ski according to claim 1, wherein the shock absorption elements comprise an upper strip positioned between the upper wall of said core and the upper wall of the body.

4. A ski according to claim 1, wherein the shock absorption elements comprise a lower strip positioned between the lower wall of said core and the lower wall of the ski.

5. A ski according to claim 1, wherein the shock absorption elements comprise an upper strip positioned between the upper wall of said core and the upper wall of the body and a lower strip positioned between the lower wall of said core and the lower wall of the body.

6. A ski according to claim 5, wherein the shock absorption elements comprise two lateral strips of viscoelastic material that link said upper and lower strips.

7. A ski according to claim 1, wherein the core has at least one zone of reduced thickness defined by providing a depression in a wall of the core.

8. A ski according to claim 7, wherein the core has a depression on its upper wall filled with said viscoelastic material.

9. A ski according to claim 7, wherein the core has a depression on its lower wall filled with said viscoelastic material.

10. A ski according to claim 7, wherein the core has at least one depression on its upper wall filled with said viscoelastic material.

11. A ski according to claim 8, wherein the depression is adjacent one of the ends of the ski.

12. A ski according to claim 8, wherein the depression is adjacent the front end of the ski.

13. A ski according to claim 8, wherein the depression is adjacent the rear end of the ski.

14. A ski according to claim 8, wherein the depressions are provided adjacent the front and rear ends of the ski.

15. A ski according to claim 8, wherein the depression is adjacent the middle of the ski.

16. A ski according to claim 9, wherein the depression is adjacent one of the ends of the ski.

17. A ski according to claim 9, wherein the depression is adjacent the front end of the ski.

18. A ski according to claim 9, wherein the depression is adjacent the rear end of the ski.

19. A ski according to claim 9, wherein the depressions are provided adjacent the front and rear ends of the ski.

20. A ski according to claim 9, wherein the depression is adjacent the middle of the ski.

21. A ski according to claim 10, wherein the depression is adjacent one of the ends of the ski.

22. A ski according to claim 10, wherein the depression is adjacent the front end of the ski.

23. A ski according to claim 10, wherein the depression is adjacent the rear end of the ski.

24. A ski according to claim 10, wherein the depressions are provided adjacent the front and rear ends of the ski.

25. A ski according to claim 10, wherein the depression is adjacent the middle of the ski.

26. A ski comprising:

(a) a longitudinally extending body defining a longitudinal median plane, and having a sole substantially perpendicular to the plane and adapted to slidably engage a surface, said sole having a central zone lying between front and rear contact lines;

(b) said body comprising:

(1) a core having opposed top and bottom walls, and opposed lateral side walls, said core extending substantially the length of the body;

(2) a shell have a top wall facing the top wall of the core, a bottom wall facing the bottom wall of the core and lateral surfaces spaced from respective lateral walls of the core; and (3) a first strip of viscoelastic material interposed between one wall of said shell and the facing wall of said core for forming shock absorption means;

(c) the area and configuration of the cross-section of said first strip being a non-constant function of the length of said body at least between said contact lines.

27. A ski comprising:

(a) a longitudinal extending body defining a longitudinal median plane, and having a sole substantially perpendicular to the plane and adapted to slidably engage a surface, said sole having a central zone line between front and rear contact lines;

(b) said body comprising: (1) a core having a opposed top and bottom walls, and opposed lateral side walls, said core extending substantially the length of the body; (2) a shell having a top wall facing the top wall of the core, a bottom wall facing the bottom wall of the core, and lateral surfaces spaced from respective lateral side walls of the core; and (3) a first strip of viscoelastic material interposed between one wall of said shell and facing wall of said core for forming shock absorption means;

(c) the area and configuration of the cross section of said first strip being a non-constant function of the length of said body, at least between said contact lines;

(d) wherein the width of said core measured between the opposed lateral walls thereof is substantially constant in the longitudinal direction of said core.

28. A ski according to claim 26 wherein the thickness of said first strip longitudinally as a non-constant function of distance in the longitudinal direction.

29. A ski according to claim 26 including a second strip interposed between the bottom wall of said shell and the bottom wall of said core for forming shock absorption means.

30. A ski according to claim 29 wherein said first and second strips are substantially continuous over the length of said body.

31. A ski according to claim 29 wherein the thickness of said core measured between its upper and lower walls is greater in the central zone of the ski than adjacent the front and rear contact lines.

32. A ski according to claim 29 wherein the thickness of said core measured between its upper and lower walls is reduced adjacent one of said contact lines relative to the thickness in said central zone.

33. A ski according to claim 32 wherein the thickness of said core is reduced in the vicinity of said front contact line.

34. A ski according to claim 32 wherein the thickness of said core is reduced in the vicinity of said rear contact line.

35. A ski according to claim 32 wherein the thickness of said core is reduced by proving a depression in a wall of the core.

36. A ski according to claim 31 wherein the transition in thickness of said core is discontinuous.

37. A ski according to claim 31 wherein the transition in thickness of said core is continuous.

38. A ski according to claim 29 wherein the thickness of said core is reduced adjacent said central zone relative to the width adjacent one of said contact lines.

39. A ski according to claim 38 wherein the core is provided with a depression in the top wall thereof in the central zone of the core.

40. A ski according to claim 38 wherein the core is provided with a depression in the bottom wall thereof in the central zone of the core.

41. A ski according to claim 1 including a longitudinal strip of viscoelastic material interposed between the bottom wall of said core and the bottom wall of said shell for forming shock absorption means.

42. A ski according to claim 41 wherein said longitudinal strip is substantially continuous over the length of said body.

43. A ski according to claim 35 wherein said core is symmetrical about said median plane.

44. A ski according to claim 35 wherein said core is asymmetrical about said median plane.

45. A ski according to claim 26 wherein said shell includes a reinforcement layer that resists mechanical strain on the ski.

46. A ski according to claim 45 wherein said reinforcement layer is metallic.

47. A ski according to claim 26 wherein said top wall and said lateral surfaces of said shell include a reinforcement layer that resists mechanical strain on the ski.

48. A ski according to claim 26 wherein the sole of the ski is cambered.

49. A ski according to claim 26 wherein the width of said core in a direction perpendicular to said median plane is uniform.

50. A ski according to claim 26 wherein the width of said ski measured between the lateral surfaces of the shell is substantially constant between said contact lines.

51. A ski according to claim 26 wherein said lateral surfaces of said shell are inclined relative to said median plane.

52. A ski according to claim 27, wherein said first strip of viscoelastic material is interposed between the top wall of the shell and the top wall of the core.

53. A ski according to claim 52, wherein the core has at least one zone of reduced thickness defined by a depression in a wall of the core.

54. A ski according to claim 53, wherein said depression is in the top wall of the core.

55. A ski according to claim 54, wherein said depression is adjacent one of the ends of the ski.

56. A ski according to claim 55, wherein the depression is adjacent the front end of the ski.

57. A ski according to claim 55, wherein the depression is adjacent the rear end of the ski.

58. A ski according to claim 55, wherein a depression is formed in the top of the ski at each end thereof adjacent the contact lines.

* * * * *